US009095483B2

(12) United States Patent
Storm

(10) Patent No.: US 9,095,483 B2
(45) Date of Patent: Aug. 4, 2015

(54) FULL PERINEAL WASH SYSTEM WITH REMOVABLE SEAT

(75) Inventor: David B. Storm, Cookeville, TN (US)

(73) Assignee: Storm Showers, LLC, Cookeville, TN (US)

( * ) Notice: Subject to any disclaimer, the term of this patent is extended or adjusted under 35 U.S.C. 154(b) by 815 days.

(21) Appl. No.: 13/273,427

(22) Filed: Oct. 14, 2011

(65) Prior Publication Data

US 2012/0030870 A1 Feb. 9, 2012

Related U.S. Application Data

(63) Continuation-in-part of application No. 12/579,640, filed on Oct. 15, 2009, now Pat. No. 8,677,520.

(30) Foreign Application Priority Data

Oct. 14, 2010 (CA) ..... 2717608

(51) Int. Cl.
*A47K 3/022* (2006.01)
*A61G 5/10* (2006.01)
*A61G 5/14* (2006.01)

(52) U.S. Cl.
CPC ..... *A61G 5/1002* (2013.01); *A61G 5/14* (2013.01)

(58) Field of Classification Search
USPC ..... 4/420.4, 444, 447, 448, 560.1, 604, 4/578.1; 297/452.63, 45, DIG. 4
See application file for complete search history.

(56) References Cited

U.S. PATENT DOCUMENTS

| | | | | |
|---|---|---|---|---|
| 1,638,040 | A * | 8/1927 | Killen | 4/480 |
| 2,748,834 | A * | 6/1956 | Schwinn | 4/237 |
| 3,040,335 | A * | 6/1962 | Gellmann | 4/570 |
| 3,116,492 | A * | 1/1964 | Christensen | 5/85.1 |
| 3,196,465 | A * | 7/1965 | Montgomery | 4/578.1 |
| 5,680,661 | A | 10/1997 | Foster et al. | |
| 6,516,477 | B1 | 2/2003 | Storm | |

* cited by examiner

*Primary Examiner* — Tuan N Nguyen
(74) *Attorney, Agent, or Firm* — Knox Patents; Thomas A. Kulaga

(57) ABSTRACT

Apparatus for a perineal wash system includes a seat with a pair of pads spaced apart front to back to define a gap. The pads and frame define front and rear access areas dimensioned to allow a caregiver to access the perineal area of a seated person. In various embodiments at least one pad is movable sideways and may include a biasing spring, an operating handle, and/or a latch. The seat is suitable for a shower chair, a wall-mounted chair, and a bathtub chair. A gas spring optionally lifts one end of the seat. In one embodiment a perineal washer is supported adjacent the seat. The washer receives a nozzle of a sprayer and redirects the spray through a movable conduit to direct liquid upward to the perineum. In one embodiment a commode pot below the seat has a gap sufficient to avoid pinching dangling body parts.

19 Claims, 10 Drawing Sheets

Fig. 7
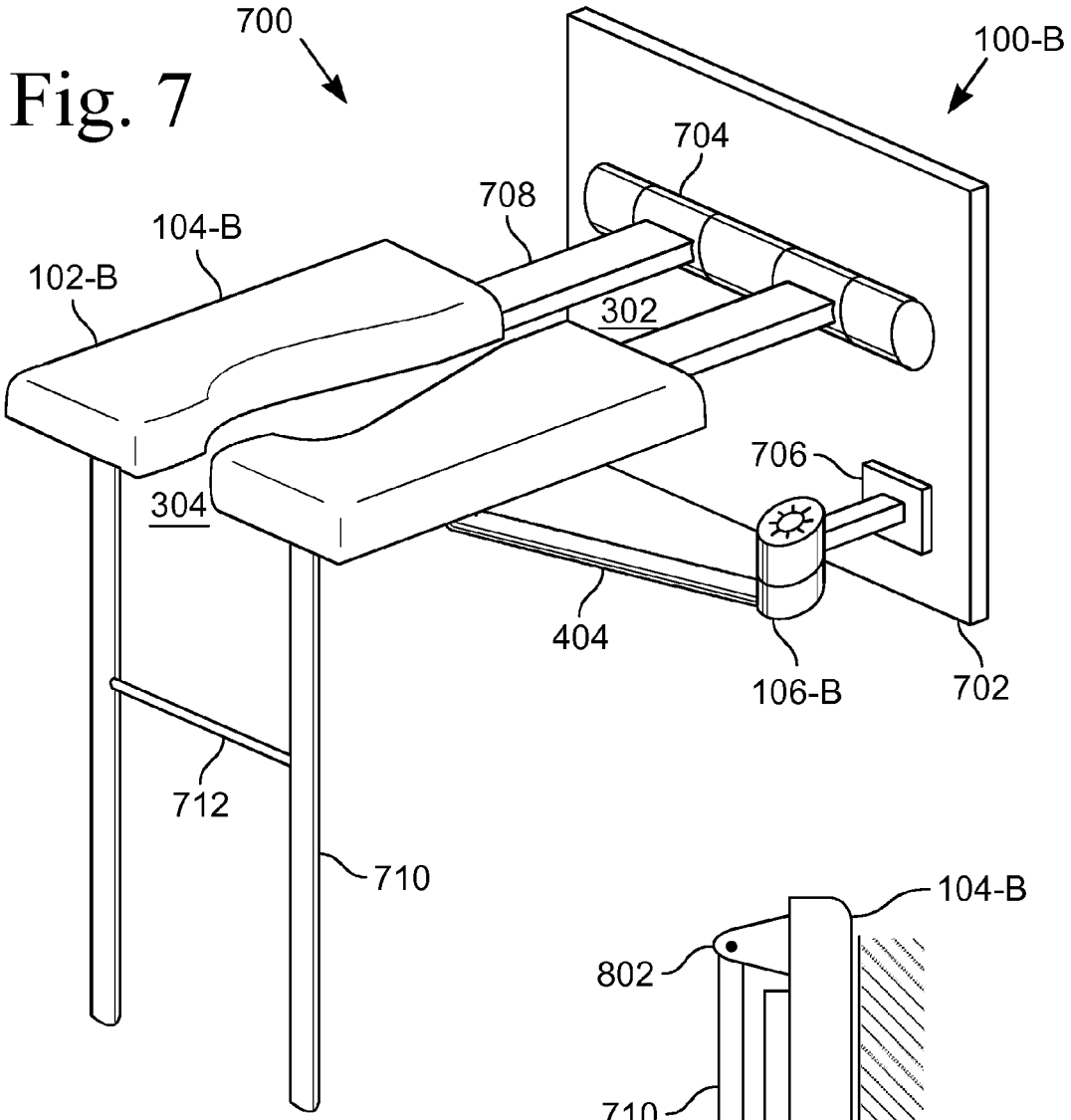
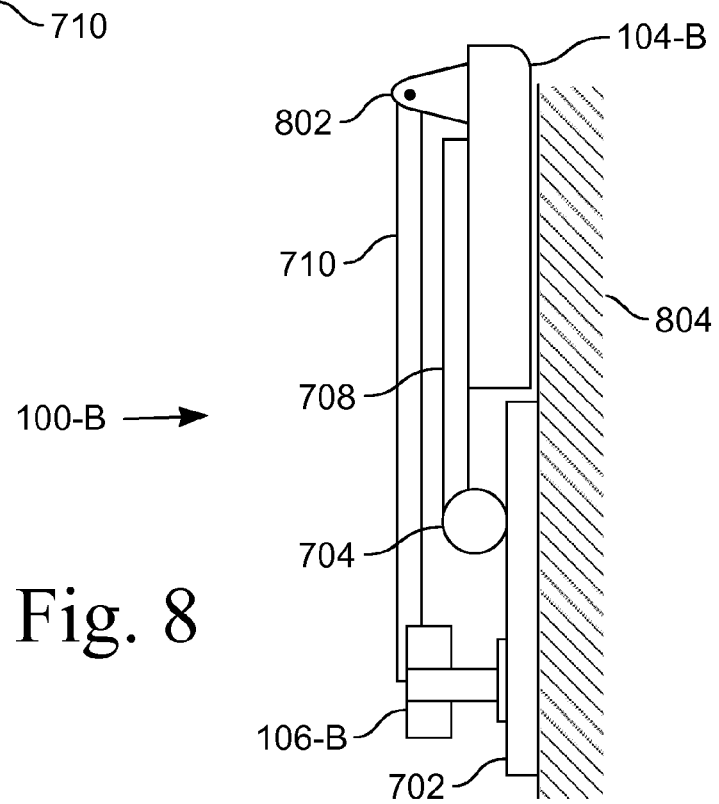
Fig. 8

FULL PERINEAL WASH SYSTEM WITH REMOVABLE SEAT

CROSS-REFERENCE TO RELATED APPLICATIONS

This application is a continuation-in-part of prior application Ser. No. 12/579,640, filed Oct. 15, 2009. This application claims the right of priority of Canada Patent Application Number 2,717,608, filed Oct. 14, 2010, hereby incorporated by reference, which claims the benefit of U.S. application Ser. No. 12/579,640, filed Oct. 15, 2009.

STATEMENT REGARDING FEDERALLY SPONSORED RESEARCH OR DEVELOPMENT

Not Applicable

BACKGROUND OF THE INVENTION

1. Field of Invention

This invention pertains to a perineal wash system that provides for full access to the perineum, urethra, and genitalia of a seated person. More particularly, this invention pertains to a seat that allows a caregiver to fully access the perineum, urethra, and genitalia of a person sitting in the seat and to a perineal washer that redirects fluid from a hand-held spray nozzle that redirects fluid to the perineal area of the seated person.

2. Description of the Related Art

Elder care facilities often provide hygienic care for its residents. Daily bathing in warm flowing water is both a hygienic and relaxing activity. Incontinent accidents commonly occur when persons are bathed in warm flowing water because of the relaxation of the body. Because the bathing areas in care facilities are often shared by multiple persons, it is not unusual for one person to come into contact with the waste of another person. For example, elderly persons are transported to a common wash area in a wheeled bath chair. The person is bathed while seated in the chair. Common bath chairs sometimes have a pot or bucket for catching fecal matter or other wastes from an incontinent person seated in the chair. These pots are not often used because of the pinching that occurs when the pot is removed with the person seated in the chair. Also, because the bath chair has wheels and is used to transport the person, the wheels often pass through the bodily waste and track that waste on the floor as the person is transported from the bathing area.

*Clostridium difficile* (*C. Difficile* or *C. Diff*) is a deadly bacteria. It is the most serious cause of antibiotic-associated diarrhea (AAD) and can lead to pseudomembranous colitis, a severe infection of the colon. The *C. difficile* bacteria naturally reside in the body at non-toxic levels, normally. Transmission of *C. difficile* from one person to another often follows the vector from fecal matter to oral ingestion, such as can occur when fecal matter contaminates an object that is then touched by someone. The person has contaminated hands, which handles food and/or medicine, which causes the contamination to be ingested, thereby infecting the person. The infected person may experience overgrowth of *C. difficile*. The overgrowth is harmful because the bacterium releases toxins that potentially causes bloating, constipation, and diarrhea with abdominal pain, which may become severe. In elderly persons or those with frail immune systems, overgrowth of *C. difficile* often has severe, and sometimes deadly, consequences.

Many elderly or handicapped persons are not able to stand while being bathed. Such persons are often bathed while seated in a chair, such as a shower chair. Some elderly and handicapped persons have limited mobility and are able to stand for short periods, but are often cared for while seated. Elderly persons and handicapped persons benefit from being bathed by a caregiver when the person is in a seated position. Common bath chairs have a round seat or a seat that is open only in the front, making it difficult, if not impossible, for the caregiver to wash the perineal area of the person seated in the chair. Such a seated position makes it difficult for the caregiver to wash the perineum of the seated person because access by the caregiver is limited by the seated position and the seat. Accordingly, there is a need to be able to wash an elderly or handicapped person while that person is seated. Also, in a care facility with numerous persons needing care, there is a need to be able to transport such persons to a washing area without contaminating the care facility and the caregivers. Additionally, there is a need for caregivers to wash and otherwise care for persons without becoming contaminated by waste, including fecal matter, from the person being cared for.

BRIEF SUMMARY OF THE INVENTION

According to one embodiment of the invention, a seat in two parts with the parts configured to support the buttocks of a person sitting on the seat, the two parts of the seat separated by a gap sufficiently large to allow access, front and rear, to the perineum of the seated person for a caregiver to clean the perineum area, is provided. In this way, the caregiver is able to wash and clean the perineum, urethra, and genitalia of a person who is not capable of caring for themselves, such as if the person is incontinent.

In one embodiment, the seat is incorporated in a chair, such as a shower chair. The seat includes a left pad and a right pad with a gap between the two pads. At the front of the seat, the chair supports are configured to provide a space sufficient to allow a caregiver to reach between the seat pads and clean the genital area and the perineal area of a person seated in the chair. At the rear of the seat, the chair supports are configured to provide a space sufficient to allow a caregiver to reach between the seat pads and clean the anal area and perineum of a person seated in the chair. In this way, the chair does not restrict access to the perineum of the occupant of the chair.

In one such embodiment, the chair is configured to allow the chair to be positioned over a waste receptacle extending upwards from the floor. That is, the frame of the chair defines a volume that is sized to receive the waste receptacle and the volume is not bounded on the rear of the chair and on the bottom of the chair. For example, the chair has frame that is open on the rear of the chair by not having a left-to-right member below the seat support and rearward of the portion of the seat that normally corresponds to the body portion that exhausts human waste. In another such embodiment, the chair has a pair of rails under the seat that are spaced apart to receive and support a commode pot. The rails are suspended below the seat by a distance sufficient to provide clearance between the lip of the commode pot and the seat to prevent capturing or pinching any hanging body parts of the seat occupant.

In a further embodiment, one or both of the seat pads are movable. In one embodiment, the seat pad pivots on the forward section and allows the rear section of the pad to move away from the other pad. In another embodiment, the seat paid translates sideways. In this way the buttocks of a person sitting on the seat are separated, thereby allowing a caregiver to better access the perineum through the separated cleavage of the buttocks. In one such embodiment, the seat pad has a pivot in the front and a pin in the rear that engages a slotted opening on a support member. The seat pad is spring biased to a normal position proximate the other seat. A handle connected to the seat pad allows a caregiver or other person to pull the seat pad away from the other pad, thereby separating the buttocks cleavage. In another such embodiment, the seat pads have a configuration that causes them to move away from each other as the occupant sits down. When someone sits on the seat, the pads are forced apart by the person's body weight. When the person gets up from the seat, the biased pads return to the closed position.

In another embodiment, the seat is incorporated in a fold-down platform. The pair of pads are supported in a horizontal position at a specified distance from a wall. The front of the seat is open and allows access to the genital area of the seat's occupant and the ventral perineum. For the embodiment where the seat is further supported with folding legs, any cross-brace is sufficiently far from the seat to not inhibit access to the area between the pair of pads. The rear of the seat is at a distance from the wall and hinge such that a caregiver can reach through the gap between the seat and the wall to access the anal area and the dorsal perineum.

In yet another embodiment, the seat is incorporated in a bathtub chair. The chair fits inside a bathtub and is supported by the upper rim of the tub. Between the pair of pads and under the open area for wiping is at least one center support that rests on the floor of the tub.

Yet another embodiment of the seat, a gas spring is positioned under the front of each seat pad to elevate the front of the pad. By elevating the front of the seat, the perineum of the occupant is more readily accessible from the front. The gas spring has a damping feature to limit the speed at which the gas spring moves the seat. In an embodiment where the rear of the seat is elevated with a gas spring, the perineum is more readily accessible from the rear. In one such embodiment, a locking mechanism is used to secure the seat pad in position.

According to one embodiment of the invention, a perineal washer is provided. The perineal washer is a device that receives a common spray nozzle and redirects the water spray toward the perineum of a seated person. In this way, a caregiver is able to apply water to the perineum of a person without manually directing water from a nozzle upwards, which normally results in exposing the caregiver to the person's bodily waste as the water drips onto the caregiver's hand and arm and runs down the caregiver's arm. The perineal washer has a receiver into which a nozzle of a hose sprayer fits. The receiver seals the nozzle and confines the majority of the water and water pressure to the perineal washer. The receiver is in fluid communication with a conduit that is elongated and extends under the seat. The end of the conduit has a nozzle or openings that direct the water from the nozzle upwards towards the perineum of the person sitting in the seat. The perineal washer includes articulation that allows the end of the conduit to sweep across the perineum.

In various embodiments, a mechanism to prevent one or both legs of a slender person occupying the chair from falling in the space between the pair of seat pads. In one such embodiment, each seat pad has a vertical section in the forward portion of the pad. The vertical section is sufficiently rigid to support the leg and prevent it from moving sideways into the gap between the seat pads. In another embodiment, a towel bar is positioned at the forward end of the seat pads to prevent the occupant's legs from moving into the area between the seats. The towel bar is elongated and fits between two supports to bridge the space between the seat pads.

BRIEF DESCRIPTION OF THE SEVERAL VIEWS OF THE DRAWINGS

The above-mentioned features of the invention will become more clearly understood from the following detailed description of the invention read together with the drawings in which:

FIG. 7 is a perspective view of one embodiment of a fold-up seat assembly and a perineal washer;

FIG. 8 is a side view of the fold-up seat assembly in the upright or folded position.

DETAILED DESCRIPTION OF THE INVENTION

Apparatus for bathing a seated person is disclosed. Elderly persons and handicapped persons benefit from being bathed by a caregiver when the person is in a seated position. As used herein, the A and B suffixes appended to a reference number indicate an embodiment of a component. When the reference number is used without the suffix, the generic component is being referenced, for example, the generic shower chair 102 has various embodiments 102-A, 102-B, etc.

Figure 1:
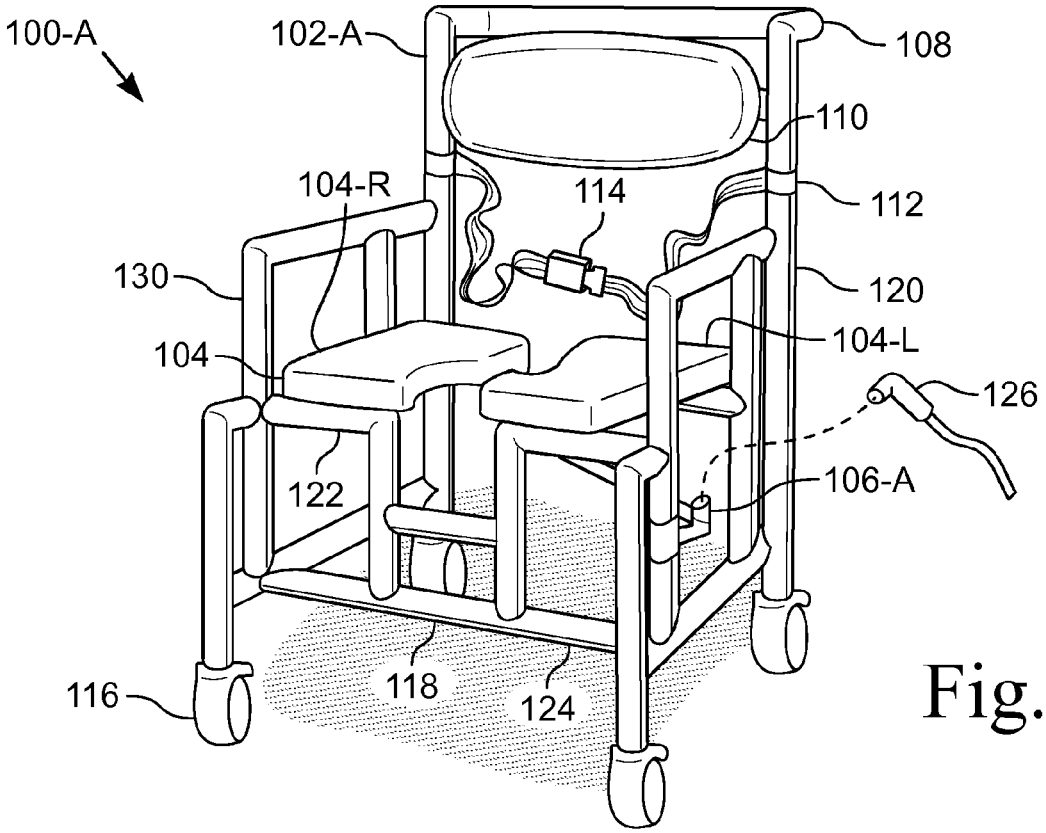
FIG. 1 is a perspective view of one embodiment of a wash system including a shower chair and a perineal washer.

FIG. 1 illustrates a perspective view of one embodiment of a wash system 100-A including a shower chair 102-A and a perineal washer 106-A that receives a nozzle 126 of a sprayer. The shower chair 102-A includes a frame 118 that supports a seat 104 and a backrest 110. The frame 118 is a formed of a lightweight, but strong, material. For example, polyvinyl chloride (PVC) pipe is cut and joined with pipe fittings to assemble the illustrated frame 118 in a chair configuration. The illustrated frame 118 has a rectilinear configuration. In other embodiments, portions of the frame 118 are curved or follow an arcuate path.

Attached to the frame 118 is a seat 104. The seat 104 includes a pair of pads 104-L, 104-R supported at a height for use by an occupant of the chair 102-A. A seatbelt 112 with a buckle 114 is positioned to secure the occupant in the chair 102, such as when the occupant is transported in the chair 102-A. The rear supports 120 of the frame 118 define an open area between the supports 120 from the floor up to the bottom of the supports 122 of the seat 104. The volume under the seat 104 and its supports 122 is open and unobstructed, and the volume extends from the front support 124 to the rear supports 120. The volume is unobstructed on the bottom and rear sides and is bounded by the frame 118 on the front, top, and left and right sides.

The illustrated chair 102-A is maneuverable. The chair 102-A has wheels, or castors, 116 that allow the chair 102 to be moved as needed. A handle 108 is situated at the upper end of the rear vertical members 120 and allows a caregiver to maneuver the chair 102-A. A vertical member 130 supports an arm rest so that the occupant is encouraged to keep his arms within the confines of the chair 102-A.

Figure 2:
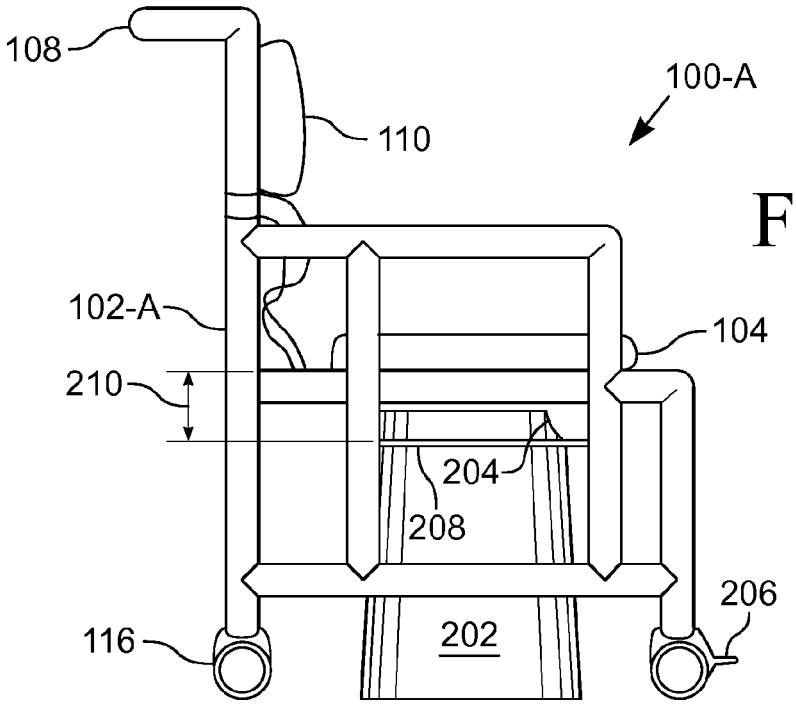
FIG. 2 is a side view of a wash system including a waste receptacle.

FIG. 2 illustrates a side view of a wash system 100-A with a waste receptacle 202. The waste receptacle 202, in one embodiment, is a device such as disclosed in application Ser. No. 12/427,158, filed Apr. 21, 2009, and titled "Waste receiving device for incontinent persons," which is incorporated by reference. The waste receptacle 202 has a receiver at its upper end. The receiver has a strainer or filter that empties through a conduit that discharges near the bottom of the waste receptacle 202. The waste receptacle 202 is positioned over a floor drain, which receives the discharge from the waste receptacle 202. The waste receptacle 202 captures bodily waste from the occupant of the chair 102-A and allows the waste to either flow to the floor drain or be captured in the receiver of the waste receptacle 202, such as when the waste is of size too large to pass through the floor drain. In various embodiments, the waste receptacle 202 is either freestanding or fixed to the floor.

The waste receptacle 202 is positioned over a floor drain in a bathing area. The chair 102-A is positioned over the waste receptacle 202 by maneuvering the chair 102-A so that the rear supports 120 of the frame 118 pass around the waste receptacle 202. The chair 102-A is positioned such that if the occupant of the chair 102-A becomes incontinent, the occupant will defecate into the waste receptacle 202, which will capture the waste. At least one of the wheels 116 of the chair 102-A includes a wheel lock 206 that is foot operated after the chair 102-A is in position. Operating the wheel locks 206 prevents the chair 102-A from moving out of position after it is situated over the waste receptacle 202.

The waste receptacle 202 has a height that is slightly less than the inside height of the volume under the seat supports 122. The waste receptacle 202 has a recessed lip 204 on the upper end proximate the front of the chair 102-A. The edge of the recessed lip 204 is a distance 210 below the bottom of the seat 104 such that no dangling body parts of the occupant of the chair 102-A are caught or pinched between the chair 102-A and the waste receptacle 202 when the chair 102-A is moved relative to the waste receptacle 202.

Supported below the seat 104 are a pair of rails 208 that are supported a distance 210 below the seat 104. The rails 208 support a commode pot 1402 under the seat 104.

In the embodiment illustrated in FIG. 2, the perineal washer 106 is positioned so as not to interfere with the waste receptacle 202 under the seat 104. In another embodiment, the waste receptacle 202 has a height that provides for a gap between the top of the waste receptacle 202 and the bottom of the seat supports 122. The gap is sufficiently large to allow the perineal washer 106 to be used with the chair 102-A positioned over the waste receptacle 202.

Figure 3:
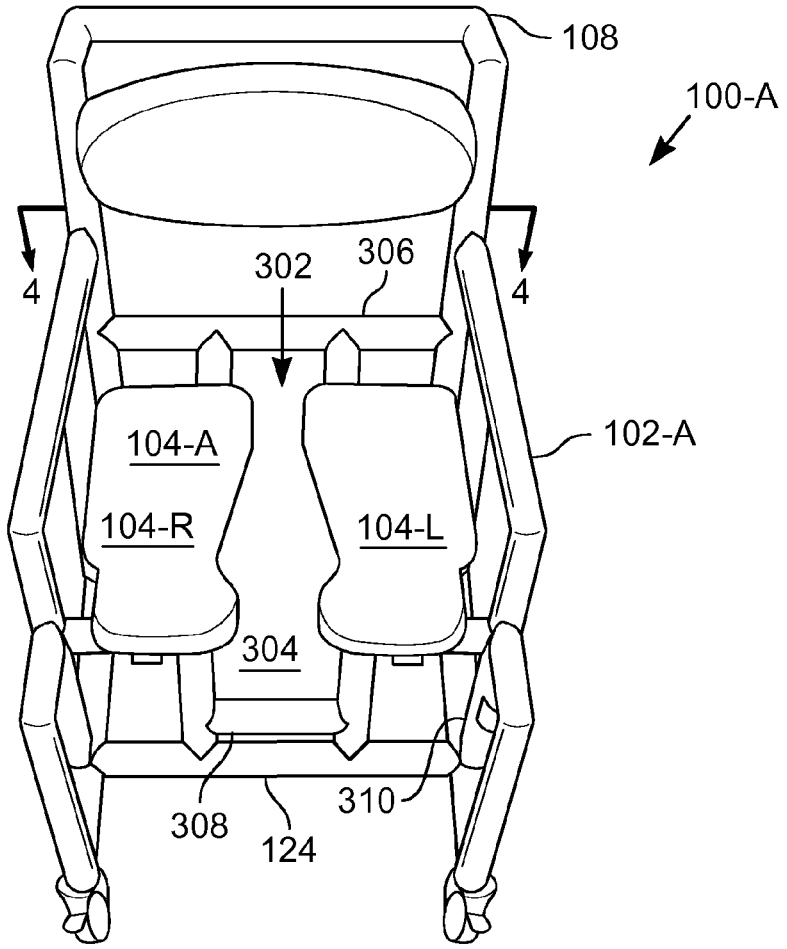
FIG. 3 is a perspective front top view of one embodiment of a shower chair.

FIG. 3 illustrates a perspective front top view of one embodiment of a shower chair 102-A. The seat 104-A has a pair of pads 104-L, 104-R that are separated from each other by a gap. The rear of the seat 104-A has a rear access area 302 between the rear cross-member 306 of the frame 118 and the seat 104-A. The rear access area 302 permits access to the anal area and the dorsal perineal area of the occupant of the seat 104-A. The front of the seat 104-A has a front access area 304 between the pair of pads 104-L, 104-R and between the pair of pads 104-L, 104-R and the cross-member 308. The front access area 304 permits access to the genital area and the ventral perineal area of the occupant of the seat 104-A.

In the illustrated embodiment, each pad 104-L, 104-R has a rear section that extends further toward the sides of the frame 118 than does the front section. The wider rear section of the pads 104-L, 104-R is the portion of the seat 104-A where the buttocks of the occupant of the chair 102-A are more likely to spread and be supported by the additional surface area of the seat pads 104-L, 104-R. That is, the wider seat pads 104-L, 104-R provide for an increased sitting area for the occupant of the chair 102-A.

Figure 4:
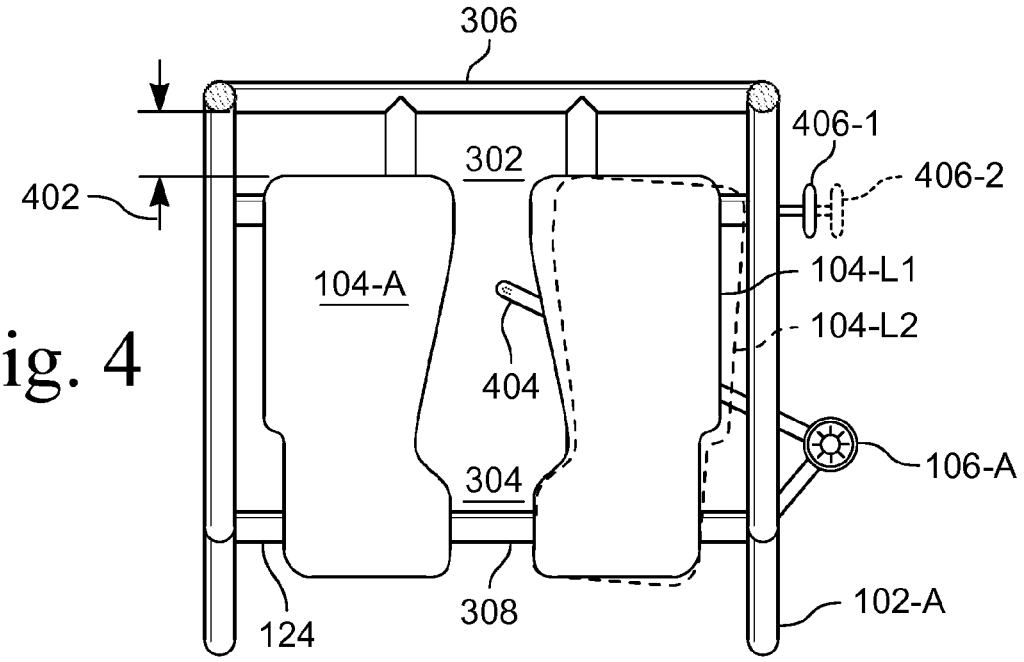
FIG. 4 is a top plan view of a shower chair and a perineal washer.

FIG. 4 illustrates a top plan view of a shower chair 102-A and a perineal washer 106. The rear access area 302 is defined by a gap 402 between the rear cross-member 306 and the rear of the seat 104-A. In one embodiment, the gap 402 is approximately eight inches, which is sufficient to receive the hand and/or arm of the caregiver when the caregiver reaches behind the occupant of the chair 102-A to manually wipe and wash the perineal area of the occupant. The gap 402 is also sufficiently sized to receive the caregiver's hand when holding a washcloth and/or other cleaning device.

The front access area 304 is defined by the separation of the seat pads 104-L, 104-R and the vertical gap between the cross member 308 and the seat 104-A. With a person sitting on the seat 104-A, the occupant's legs extend from the front of the seat 104-A. In order for a caregiver to wipe and wash the genital area and the ventral perineal area, the caregiver must reach between the occupant's legs, above the cross-member 308, and between the seat pads 104-L, 104-R. The vertical gap between the cross-member 308 and the seat 104-A and the gap between the seat pads 104-L, 104-R is sufficient for the caregiver to reach to the areas to be washed by the caregiver.

The perineal washer 106-A is attached to a vertical member 310 of the frame 118. The perineal washer 106 includes an elongated conduit 404 that has an end that is movable to direct or spray water between the pair of seat pads 104-L, 104-R. A spray nozzle 126 for washing the person engages the perineal washer 106, which redirects the fluid output from the nozzle 126 to the perineal area of the occupant of the chair 102-A.

In the illustrated embodiment, one of the seat pads 104-L is movable between a normal position 104-L1 and a separated position 104-L2 by operation of a handle 406. In other embodiments, the other seat pad 104-R or both seat pads 104-R, 104-L are movable. The rear portion of one seat pad 104-L moves sideways, changing the width of the gap between the two seat pad 104-R, 104-L at the rear of the seat 104. When a person sits on the seat 104, each cheek of the buttocks rests on one of the seat pads 104-R, 104-L. One seat pad 104-L pivots such that the rearmost portion forms a wider gap between the two seat pads 104-R, 104-L. The separation of the pads 104-R, 104-L also separates the cheeks of the buttocks, allowing a caregiver easier access to the perineum of the occupant. The pads 104-R, 104-L are separated by the caregiver pulling the handle 406 from a normal position 104-L1 to an extended position 406-L2. In one embodiment, the handle 406 is spring loaded and the caregiver must continue pulling the handle 406-2 while cleaning the perineum. In another embodiment the handle 406 latches in the extended position 406-2, thereby allowing the caregiver to use both hands to clean the perineum.

Figure 5:
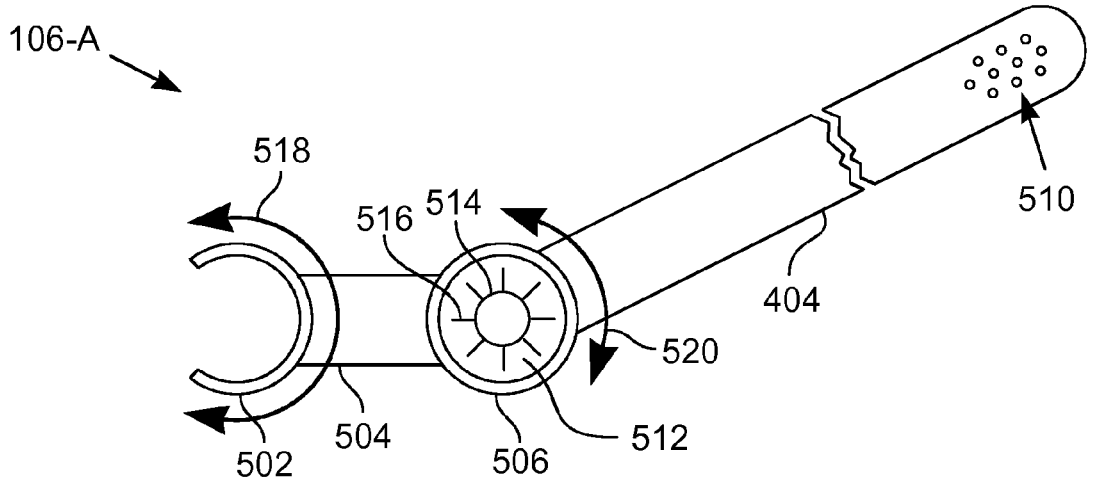
FIG. 5 is a top plan view of one embodiment of a perineal washer.
Figure 6:
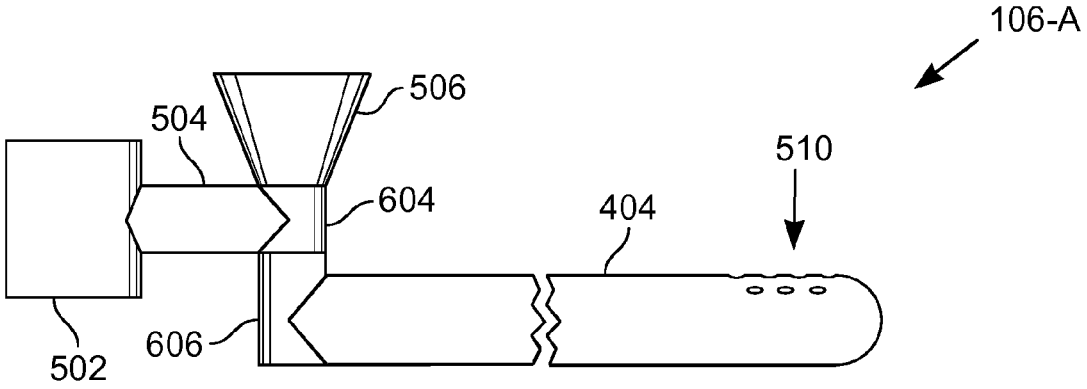
FIG. 6 is a side view of the perineal washer.

FIG. 5 illustrates a top plan view of one embodiment of a perineal washer 106-A. FIG. 6 illustrates a side view of the perineal washer 106-A. The illustrated embodiment of the perineal washer 106-A includes a clamp 502 that has a C-shaped configuration that fits partially around a vertical member 310 of the chair frame 118. The C-shaped configuration of the clamp 502 allows the perineal washer 106-A to rotate 518 around the longitudinal axis of the vertical member 310. The clamp 502 is releasably connectable to the vertical member 310 and is readily repositioned on the member 310 or on another vertical member of the frame 118.

Extending from the clamp 502 is an attachment member 504 connected to a swivel 604. Above the swivel 604 is a receiver 506 and below the swivel 604 is connector 606. The connector 606 supports the elongated conduit 404, which has multiple openings 510 at the end, forming a nozzle to spray water upward. The receiver 506 is in fluid communication with the connector 606, and both rotate 520 together relative to the swivel 604, which in the illustrated embodiment is a sleeve that surrounds the conduit connecting the receiver 506 to the connector 606.

The receiver 602 in the illustrated embodiment is a funnel-shaped device that receives a spray nozzle 126 attached to a hose. In other embodiments, the receiver 506 is cylindrical and sized to mate with the nozzle 126. One such embodiment is illustrated in FIG. 8. The receiver 506 includes a seal 512, which in the illustrated embodiment is a resilient material with a central opening 514 and radial slits 516 that allow the opening 514 to expand to receive the spray end of the nozzle 126. The tip of the nozzle 126 is pushed against the seal 512 such that the opening 514 is enlarged by the resilient material between the radial slits 516 deforming. After the tip of the nozzle 126 is inserted in the seal 512, the resilient material grips the nozzle 126 as the material between the radial slits 516 engages the nozzle 126.

The perineal washer 106-A has two articulated joints. The clamp 502 has a partial cylindrical shape that engages and rotates 518 around the longitudinal axis of a vertical member 310. The receiver 506, connector 606, and elongated conduit 404 rotate 520 relative to the attachment member 504 and the swivel 604. The articulation permits the end of the elongated conduit 404 with the openings 510 to be positioned under the perineum of the occupant of the chair 102.

In use, the nozzle 126 from a sprayer is inserted in the receiver 506 such that the nozzle 126 engages the seal 512. For the condition where the seal 512 grips the nozzle 126, the caregiver rotates the nozzle about a vertical axis to cause the conduit 404 to rotate 520 into a desired position under the seat 104. The caregiver also translates the nozzle 126 to cause the washer 106-A to rotate 518 about the vertical member 310 if such is needed to position the conduit 404. When the conduit 404 and the spray openings 510 are in position, the caregiver operates the nozzle 126 to direct fluid through the nozzle 126, into the perineal washer 104-A, and out the spray openings 510. The fluid is sprayed upwards toward the perineum of the occupant of the chair 102. The caregiver manipulates the nozzle 126 to position the spray openings 510 where desired as the perineal area is washed. In the embodiment where the seal 512 does not grip the nozzle 126 tightly enough to allow the perineal washer 104-A to be positioned, the caregiver grips the nozzle 126 and the receiver 506 to manipulate both together to direct the spray from the openings 510 where desired.

FIG. 7 illustrates a perspective view of another embodiment of a wash system 100-B that includes one embodiment of a fold-up seat assembly 700 and another embodiment of a perineal washer 106-B. In another embodiment, the hinge 704 is attached directly to the wall 804. The fold-up seat assembly 700 is a fold-up chair 102-B in which the wall provides a support for the rear of the seat assembly 700. The fold-up seat assembly 700 has two positions, a lowered position and an upright position. The lowered position is illustrated in FIG. 7 and is suitable for an occupant to sit on the seat 104-B, such as when the person is bathing in a shower or bathtub. The upright position is the folded position and positions the sitting surface of the seat 104-B parallel to the flat surface 702 and the wall 804. FIG. 8 illustrates a side view of the fold-up seat assembly 700 in the upright or folded position.

A flat surface 702, such as a mounting plate on a wall 804, provides an attachment for a hinge 704 and a perineal washer 106-B that has a mounting plate 706. The hinge 704 is attached to the flat surface 702 and to a pair of arms 708 that form part of a frame that support the seat 104-B. The arms 708 rotate about the axis of the hinge 704 to swing the seat 104-B upward against the wall. The arms 708 support the seat 104-B a selected distance from the flat support 702 so as to provide for a rear access area 302. The area 302 is dimensioned to allow the caregiver to access the anal area and the dorsal perineal area of the occupant of the seat 104-B.

In the illustrated embodiment, the front of the seat 104-B is supported in the lowered position by a pair of legs 710 that are attached to the bottom of the seat 104-B at a hinge 802. The legs 710 are connected with a cross-member 712 that provides lateral support for stability of the legs 710. The front access area 304 is defined by the gap between the cross-member 712 and the seat 104-B. The gap has a dimension that is sufficient to allow a caregiver to access the genital area and the ventral perineal area of an occupant of the seat 104-B. When the fold-up seat assembly 700 is moved from the lowered position to the folded position, the legs 710 remain vertically oriented as they swivel at the hinge 802 where the legs 710 connect to the seat 104-B.

In another embodiment, the hinge 704 includes brackets that attach directly to the wall. In such an embodiment, the flat surface, or plate, 702 is not necessary to support the fold-up chair 102-B to the wall 804. In yet another embodiment, the arms 708 and legs 710 have sufficient strength that the cross-member 712 is not necessary to support the pads of the seat 104-B in a spaced apart relationship.

The seat 104-B includes a pair of pads that are separated by a gap front to back. The illustrated embodiment shows a seat 104-B that is substantially rectangular in outline with a gap extending from the front to the rear of the seat 104-B. In other embodiments the seat 104-B has an elliptical or other configuration that supports an occupant while providing access to the perineal area of the occupant.

Figure 9:
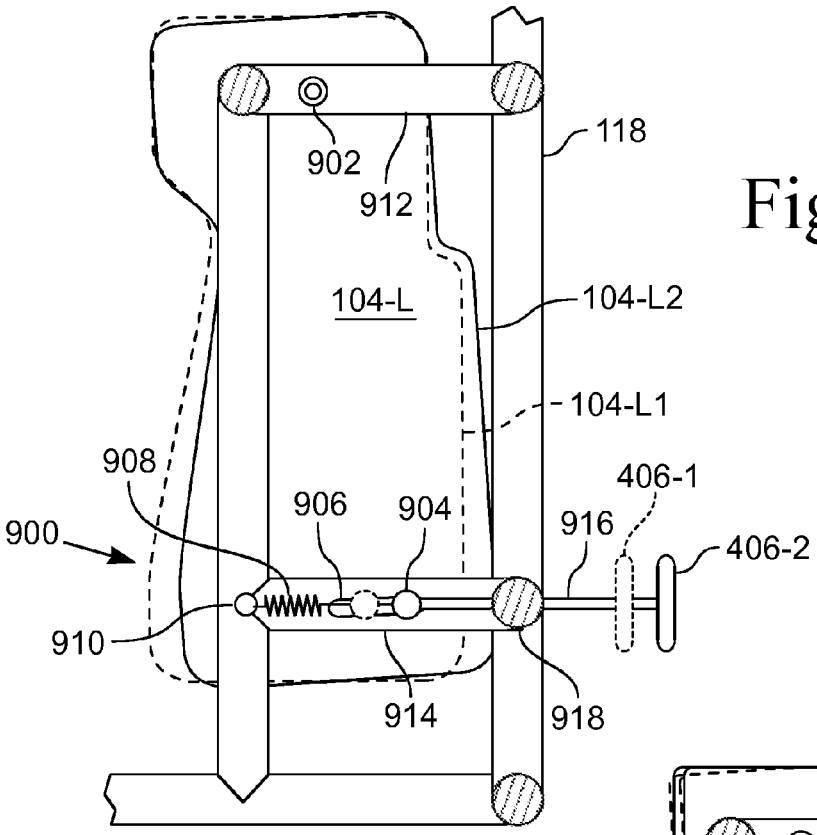
FIG. 9 is a partial bottom view showing a seat pad and one embodiment of a pad pivot mechanism.

FIG. 9 illustrates a partial bottom view showing a seat pad 104-L and one embodiment of a pad pivot mechanism 900. The seat pad 104-L has a pivot 902 attaching the front portion of the pad 104-L to the chair frame 118. In one embodiment, the pivot 902 is a fastener securing the pad 104-L to a front seat pad support 912 with a washer acting as a bearing.

The rear of the seat pad 104-L is above a rear seat pad support 914 that has an elongated, or slotted, opening 906. A pin 904 extends from the bottom of the seat pad 104-L through the slotted opening 906. The rear portion of the seat pad 104-L moves laterally between the normal, or closed, position 104-L1 and the separated position 104-L2. In one embodiment, the seat pad 104-L is held captive to the frame 118 by a distal end of the pin 904 that is larger than the narrowest portion of the slotted opening 906, thereby preventing the pin 904 from being pulled through the slotted opening 906. The pin 604 is attached to a fixed point 910 on the frame 118 by a spring 908. The spring 908 biases the seat pad 104-L to the normal position 104-L1.

In one embodiment the shaft 916 of the handle 406 runs through a vertical frame member 918 and is attached to the pin 904. The through-opening in the vertical frame member 918 provides lateral support for the handle 406. With the handle 406-1 in the normal position, the seat pad 104-L1 is in the normal position, which is the position with the rear portion of the seat pads 104-R, 104-L closest together. With the handle 406-2 in the extended position, the seat pad 104-L2 is in the separated position, which is the position with the rear portion of the seat pads 104-R, 104-L farthest apart.

In one embodiment, the spring force of the spring 908 is sufficient to pull the seat pads 104-R, 104-L together with an occupant on the seat 104. In another embodiment, the weight of the occupant is sufficient to hold the seat pads 104-R, 104-L in position after the seat pads 104-R, 104-L are positioned with the handle 406. In yet another embodiment, the seat pads 104-R, 104-L are locked in place once positioned by the handle 406, such as with a detent. In one such embodiment, a slotted block 1104 and a corresponding pivoted blade 1106 lock the seat pad 104-R, 104-L in position relative to the frame 118. In another such embodiment, a protrusion engages a series of depressions or openings to lock the seat pad 104-R, 104-L in position.

Figure 10:
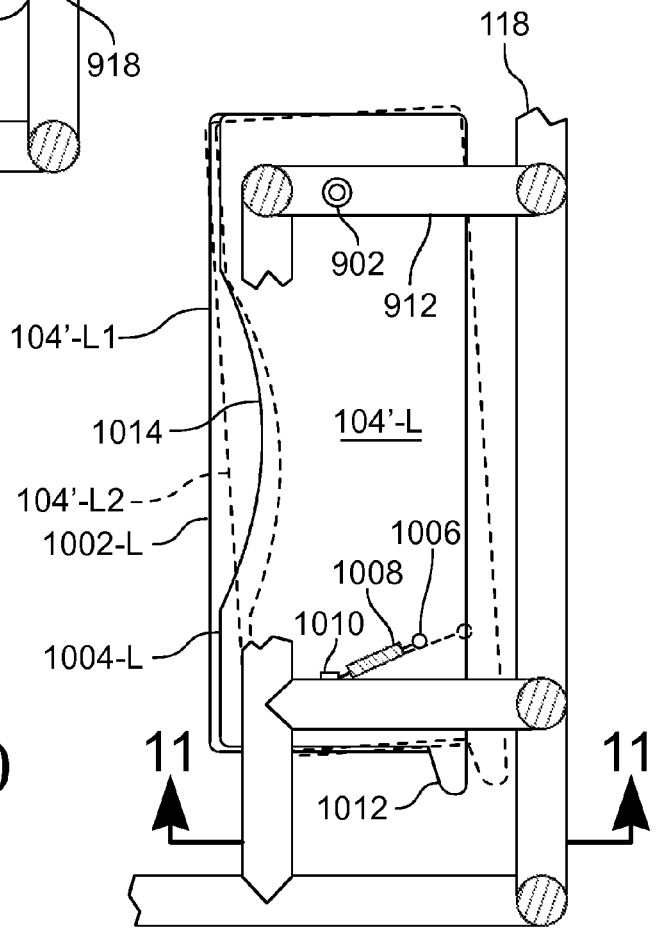
FIG. 10 is a partial bottom view showing another embodiment of a seat pad and biased pad pivot mechanism.

FIG. 10 illustrates a partial bottom view showing another embodiment of a seat pad and biased pad pivot mechanism. The seat pad 104'-L includes a base 1004-L and a cushion 1002-L. In the illustrated embodiment, the base 1004-L is a rigid material sufficiently strong to support the weight of an occupant on the seat pad 104'-L. The edge of the base 1004-L proximate the adjacent seat pad has a concave or arcuate edge 1014 that is curved inward. Attached to the upper surface of the base 1004-L is the cushion 1002-L, which has a rectangular configuration that covers the rectilinear opening formed by the concave edge 1014. The cushion 1004-L and the base 1002-L are configured such that when an occupant sits in the seat, the seat pads 104' are forced apart by the buttocks engaging the cushion 1004-L and the base 1004-L. If the weight of the occupant is not sufficient to move the seat pad 104'L into the separated position 104'-L2, a protrusion, which is a handle or knob, 1012 is positioned at the rear end of the base 1004-L. The handle 1012 is positioned such that an operator can manipulate the handle 1012, such as by pushing with a thumb. A lateral force toward the nearest outer portion of the frame 118 pivots the seat pad 104'L to the separated position 104'-L2. After the occupant is settled in the seat 104, the weight of the occupant is sufficient to maintain the seat pad 104'-L in the separated position 104'-L2.

The seat pad 104'-L has a pivot 902 attaching the front portion of the base 1004-L to the chair frame 118. In one embodiment, the pivot 902 is a fastener securing the pad 104'-L to a front seat pad support 912 with a washer acting as a bearing.

The rear of the seat pad 104'-L is above a rear seat pad support 914. The base 1004-L is a low friction material, such as high-density polyethylene (HDPE), and slides on the support 914. The rear end of the seat pad 104'-L is biased to pivot the seat pad 104'-L toward the other seat pad. In the illustrated embodiment, a spring 1008 is attached at one end 1010 to the rear support 914 and the other end 1006 of the spring 1008 is attached to the base 1004-L.

The rear portion of the seat pad 104'-L moves laterally between the normal, or closed, position 104'-L1 and the separated, or open, position 104'-L2. In one embodiment, the seat pad 104'-L is held captive to the frame 118 by the pivot 902 and the spring 1008.

Figure 11:
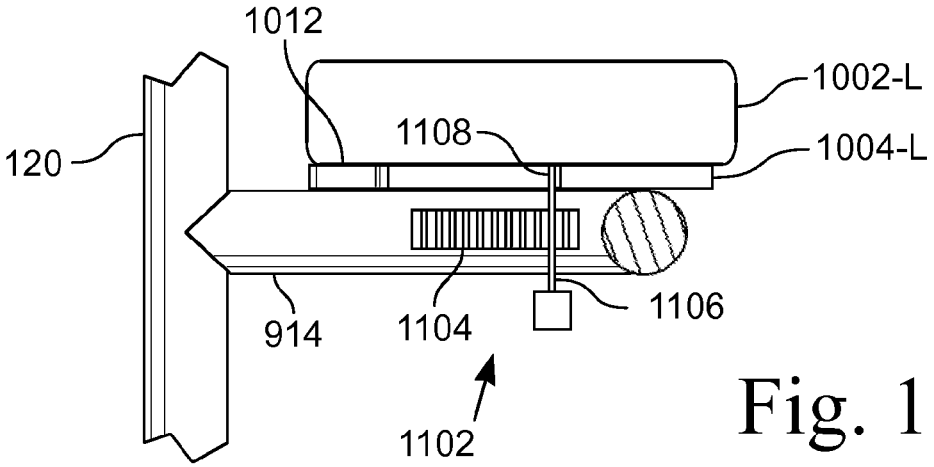
FIG. 11 is a partial front view of the seat pad of FIG. 10.

FIG. 11 illustrates a partial front view of the seat pad of FIG. 10. The cushion 1002-L is secured to the base 1004-L. In various embodiments the cushion 1002-L is attached to the base 1004-L with a hook-and-loop fastener system between the adjacent surfaces or wrapped through corresponding openings in the cushion 1002-L and the base 1004-L. The base 1004-L rests on the rear support 914 and slideably engages the rear support 914 when the seat pad 104'-L pivots.

In the illustrated embodiment, a locking mechanism 1102 is shown. The locking mechanism includes a slotted block 1104 and a corresponding pivoted blade 1106. The slotted block 1104 is attached to the support 914. The block 1104 has a series of spaced apart slots oriented vertically. Attached to the base 1004-L is a hinge 1108. A blade 1106 has one end attached to the hinge 1108. The other end of the blade 1106 has an operating handle. The blade 1106 is gravity operated and is sized so that an edge of the blade 1106 fits into the slots in the block 1104. To position the seat 104'L, the blade 1106 is lifted to disengage it from a slot in the block 1104. The seat base 1004-L is moved to the desired position and the blade 1106 is swung to engage a corresponding slot in the slotted block 1104, thereby preventing lateral movement of seat pad 104'-L In another embodiment, the seat base 1004-L has a protrusion extending downward and the slotted block 1104 is positioned such that the slots can engage the protrusion. In this way the seat 104'-L is lifted sufficiently to disengage the protrusion and the seat is moved to the desired position where the protrusion engages one of the slots to lock the seat 104'-L in position.

Figure 12:
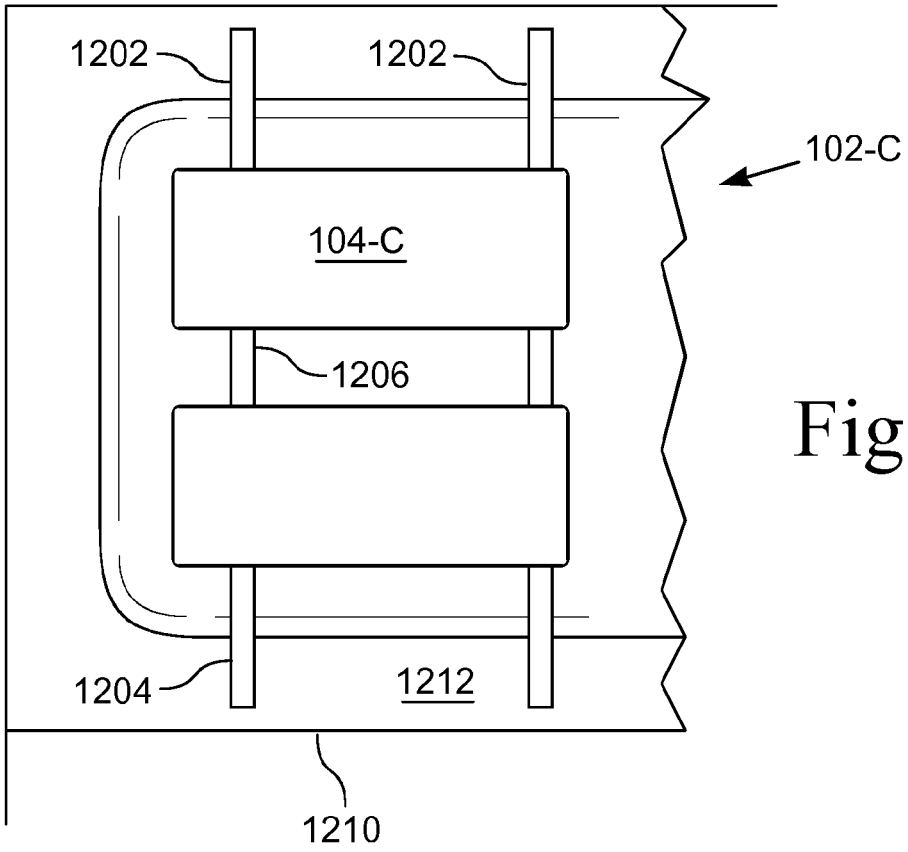
FIG. 12 is a top plan view of an embodiment of a chair for a bathtub.
Figure 13:
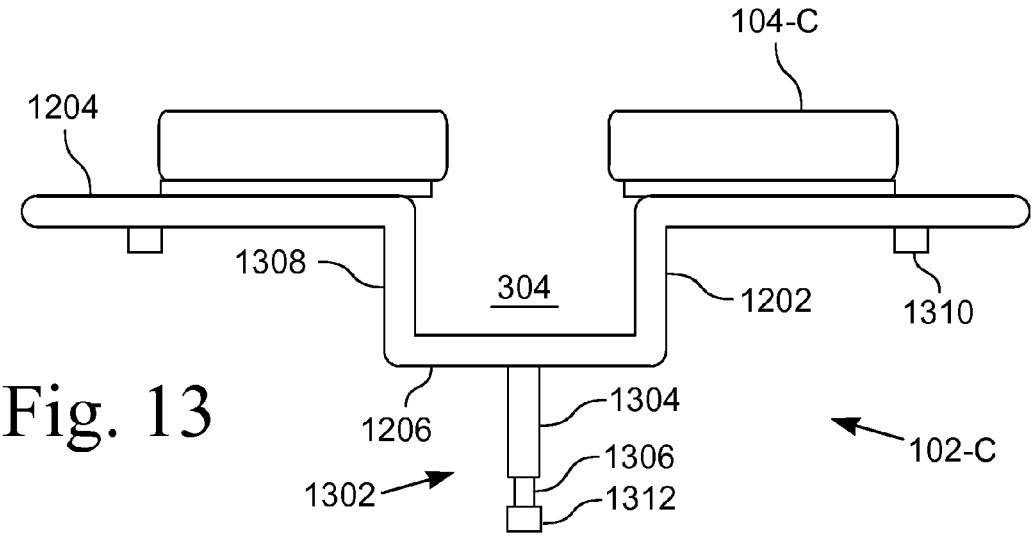
FIG. 13 is a front view of the bathtub chair of FIG. 12.

FIG. 12 illustrates a top plan view of an embodiment of a chair 102-C for a bathtub 1210. FIG. 13 illustrates a front view of the bathtub chair 102-C of FIG. 12. The bathtub chair 102-C rests on the upper lip, or apron, 1212 of the tub 1210. In the illustrated embodiment, two tubular members 1202 are attached to the two pads of the seat 104-C.

The distal ends 1204 of the tubular members 1202 extend to and support the pads of the seat 104-C. The tubular members 1202 include a pair of opposing distal ends 1204, a center support 1206, and a pair of risers 1308 that connect the distal ends 1204 to the center support 1206. The risers 1308 and center support define an access area 304 through which a caregiver is able to reach the occupant's perineum for cleaning. The two pads of the seat 104-C are separated with a gap, which is sized to allow a caregiver to wipe and clean the seat occupant's full perineum. Access is provided from both the front and rear of the occupant.

On the lower surface of the distal ends 1204 are protrusions, or stops, 1310. The stops 1310 are positioned such that when the distal ends 1204 are engaging the lip 1212 of the bathtub 1210, the stops 1310 engage the inside surface of the bathtub 1210 and prevent the bathtub seat 102-C from moving laterally. That is, the distance between the outermost edge or surface of the stops 1310 is less than or equal to the distance inside the tub 1210 proximate the lip 1212. In one embodiment, each stop 1310 is adjustable, for example, by engaging one of a series of holes in the underside of the distal end 1204.

Extending downward from the center support 1206 is a leg 1302 that supports the bathtub chair 102-C between the distal ends 1204 of the tubular member 1202. In various embodiments, one or both of the tubular members 1202 include a leg 1302. In other embodiments, such as when the tubular members 1202 have a different configuration, such as a bent planar configuration, one or more legs 1302 are used to provide support. In one embodiment the distal end of the leg 1302 is attached to a non-skid foot 1312. The non-skid foot 1312 resists movement of the bathtub seat 104-C in the tub 1210 during use when water is present.

In the illustrated embodiment, the leg 1302 telescopes in order to bridge the gap between the center support 1206 and the floor of the bathtub 1210. The telescoping leg 1302 includes an outer member 1304 and an inner member 1306 that slideably engages the outer member 1304. The two telescoping members 1304, 1306 are locked in place with a locking mechanism, for example, a pin, a detent, or a twisting lock mechanism.

In another embodiment, the risers 1308 have a length that is sufficient to extend from the seat 104-C to the floor of the bathtub 1210, upon which the center support 1206 rests. That is, the center support 1206, which may have a non-skid lower surface, rests on the floor of the bathtub 1210 and the risers 1308 extend between the center support 1206 and the portion of the frame 1202 that supports the seat 104-C. In such an embodiment, the bathtub chair 102-C does not have a leg 1302.

Figure 15:
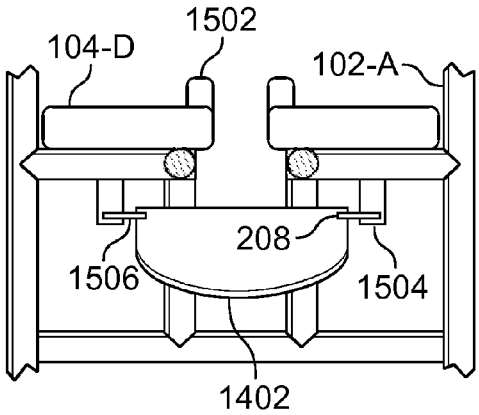
FIG. 15 is a partial rear view of a shower chair of FIG. 15.
Figure 14:
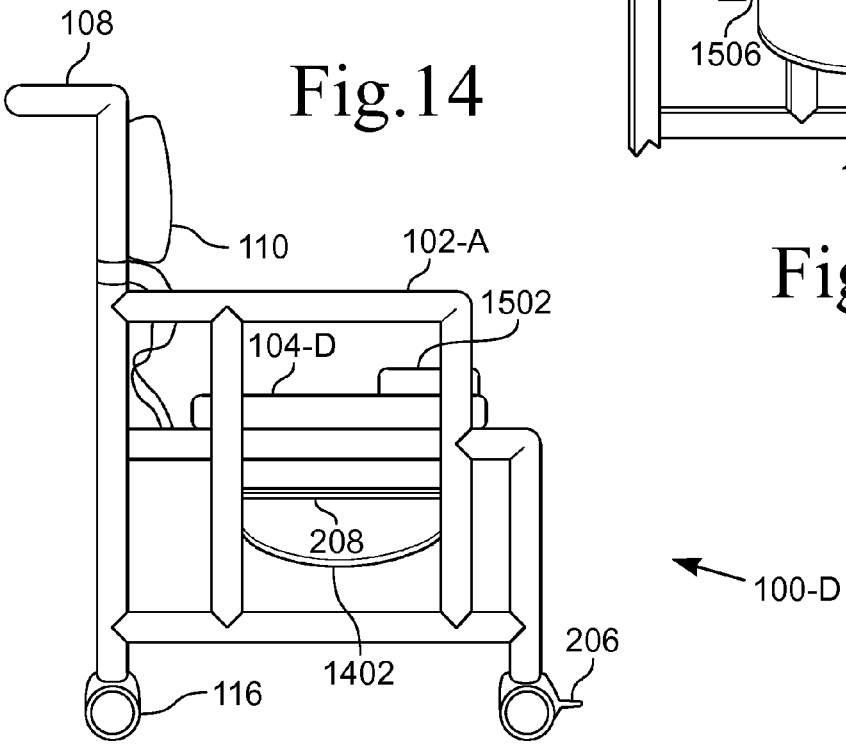
FIG. 14 is a side view of one embodiment of a shower chair with a commode pot.

FIG. 14 illustrates a side view of one embodiment of a shower chair 102 with a commode pot 1402. FIG. 15 illustrates a partial rear view of a shower chair of FIG. 10. Under the seat 104 is a pair of parallel rails 208. The rails 208 are suspended under the seat pads 104-D by stanchions 1104 positioned adjacent the ends of the rails 208. The rails 208 are spaced apart to allow a commode pot 1402 to be slid between the rails 208. In one such embodiment, the rails 208 are separated sufficiently to allow the waste receptacle 202 to fit under the seat 104-D and between the pair of rails 208.

The commode pot 1402 is configured to engage the pair of rails 208. The pot 1402 has a lip or slot 1108 on each side that engages the corresponding rail 208. In this way the pot 1402 is supported under the seat 104-D and is available to collect any waste ejected from the occupant of the seat 104.

The rear of the chair 102 is open to allow the commode pot 1402 to be removed by sliding the pot 1402 rearward along the rails 208. Because of the distance 210 between the seat bottom and the top of the pot 1402, the pot 1402 is removable without harmfully encountering any dangling body parts of the occupant of the seat 102. For example, the testicles and penis of a male occupant may hang below the seat 104-D. When the commode pot 1402 is removed, the distance 210 is sufficient that the male occupant's hanging body parts are not pinched or otherwise caught by the pot 1402. In one such embodiment, the distance 210 between the seat 104-D and the commode pot 1402 is approximately 3 to 5 inches.

FIGS. 14 and 15 illustrate another feature, namely a pair of leg spreaders 1502 that project up from the inside edge of the seat pads 104-D. The leg spreaders 1502 guide the occupant's legs to remain on the seat pads 104-D and not move into the space or gap between the seat pads 104-D. In one embodiment, the leg spreaders 1502 are made of soft, resilient material similar to that used for the seat pads 104-D.

The spreaders 1502 are dimensioned and have sufficient strength to prevent one or both of the legs of a slender seat occupant from sliding or moving into the gap 304 between the front portion of the seat pats 104-D. The spreaders 1502 are low enough and resilient enough that the spreaders 1502 are not uncomfortable when an obese person occupies the seat 100. In one such embodiment, the leg spreaders 1502 include a support plate or member, such as the support member 1706 illustrated in FIGS. 16 & 17, and the base plate is positioned adjacent the gap between the pair of seat pads 104-D. Such a base plate adds rigidity and strength to the leg spreaders 1502 while not detracting from the comfort of the occupant.

Figure 16:
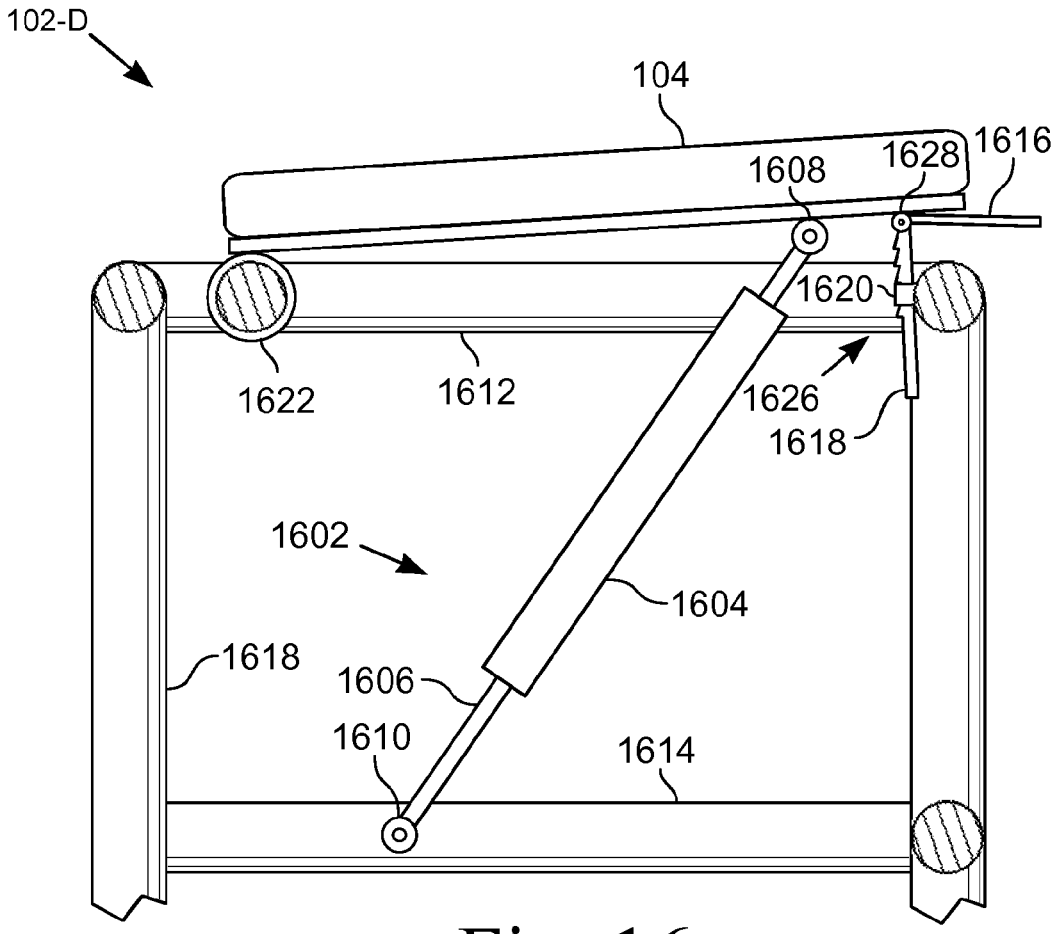
FIG. 16 is a side view of one embodiment of an assisted lift chair.

FIG. 16 illustrates a side view of one embodiment of an assisted lift chair 102-D with the seat 104 in a tilted position. The chair 102-D includes a seat 104 attached to a frame 1624 at a hinge 1622. The chair 102-D includes an assist assembly 1602 for the seat 104 and a latching assembly 1626 to secure the seat 104 at a selected position. For an embodiment in which the seat 104 has a pair of pads, each pad has an assist assembly 1602 and a latching assembly 1626. For an embodiment in which the seat 104 operates as an integrated unit, for example, there is a single pad or the two pads are mechanically connected and move as a unit, a single assist assembly 1602 and a single latching assembly 1626 may be used.

The frame 1624 includes a lower member 1614 and an upper member 1612. One end of the seat 104-D is attached to a hinge 1622 that allows the seat 104-D to pivot. In one embodiment, the hinge 1622 includes an outer sleeve that rotates around a cylindrical-shaped member of the frame 1624 that is supported in part by the upper member 1612.

The illustrated embodiment shows a seat 104 that is also supported by an assist assembly 1602 that is a gas spring. The gas spring 1602 includes gas cylinder 1604 and a rod 1606. The distal end of the gas cylinder 1604 is attached to the lower surface of the seat 104 with a swivel joint 1608, for example a ball joint. The distal end of the rod 1606 is attached to the lower support member 1614.

The gas spring 1602 is configured for the rod 1606 to exert a force relative to the gas cylinder 1604. The force acts against the seat 104 to cause it to pivot such that the end of the seat 104 opposite the hinge 1622 moves away from the upper support 1612. In one embodiment, the force is slightly less than the weight of an expected occupant of the chair 102-D. In this way, when the chair 102-D is occupied, little force is required to pivot the seat 104, thereby enabling a caregiver to readily position the seat 104 at a desired angle.

The gas spring 1602 is configured for the rod 1606 to move at a selected speed relative to the gas cylinder 1604. In various embodiments, the extension and/or compression speeds are selected or dampened. For example, in one embodiment the compression speed is selected such that, with the seat 104 at an elevated position, the seat 104 moves down with a dampened speed that accommodates the occupant when the occupant sits on the seat 104. In one such embodiment, the extension speed is not dampened, thereby allowing the caregiver to control the rate of lift when raising the end of the seat 104. In another embodiment, the extension speed is dampened such that when the seat 104 is not occupied, the seat 104 moves upward at a controlled rate.

The illustrated embodiment shows a latching assembly 1626 between the seat 104 and the frame 1624 at the opposite end of the seat 104 from the hinge 1622. The illustrated latching assembly 1626 secures the end of the seat 104 at a desired elevation. The latching assembly 1626 includes a latch handle 1616, a ratchet member 1618, and a pawl 1620. The latch handle 1616 and the ratchet member 1618 rotate about a pivot 1628. In the illustrated embodiment the ratchet member 1618 has teeth oriented to engage the pawl 1620 to prevent the seat 104 from lowering when the latch assembly 1626 is engaged. The latch assembly 1626 is gravity operated and is normally engaged. Lifting up on the latch handle 1616 disengages the latch assembly 1626 and permits the seat 104 to be lowered. In other embodiments, the ratchet member 1618 has the teeth oriented such that the seat 104 is prevented from elevating or the teeth oriented bidirectionally such that the seat 104 is prevented from moving in either direction when the latching assembly 1626 is engaged.

In another embodiment, the latching assembly is incorporated in the gas spring 1602. For example, the gas spring 1602 is lockable or has a locking mechanism between the gas cylinder 1604 and the rod 1606. In still another embodiment, the latching assembly is a mechanical assembly that fixes the position of the seat 104 at a desired elevation.

The seat 104 of the assisted lift chair 102-D has a first, or lowered, position. In the lowered position the seat 104 compresses the gas spring 1602. The seat 104 has at least on other position, which is a raised, tilted, or elevated position. In the elevated position, the seat 104 is pivoted at an angle with the rod 1606 extended from the gas cylinder 1604. For example, the lowered position is one with the seat 104 substantially horizontal and the elevated position is one with the end of the seat 104 opposite the hinge 1622 raised approximately one and one-half inches (38 mm).

In one embodiment, the hinge 1622 is located at the rear end of the seat 104. In this way, the front of the seat 104 is elevated to permit access to the occupant's perineum area from the front for cleaning by a caregiver. In such an embodiment, the latching assembly 1626 fixes the seat 104 at an elevated position and prevents the seat 104 from lowering when the latching assembly 1626 is engaged.

In one embodiment, the hinge 1622 is located at the front end of the seat 104. In this way, the rear of the seat 104 is elevated to permit access to the occupant's perineum area from the rear for cleaning by a caregiver. Additionally, with the rear of the seat 104 elevated, the occupant is assisted in sitting and exiting the assisted lift chair 102-D. In such an embodiment, the latching assembly 1626 fixes the seat 104 at an elevated position and prevents the seat 104 from lowering when the latching assembly 1626 is engaged.

Figure 17:
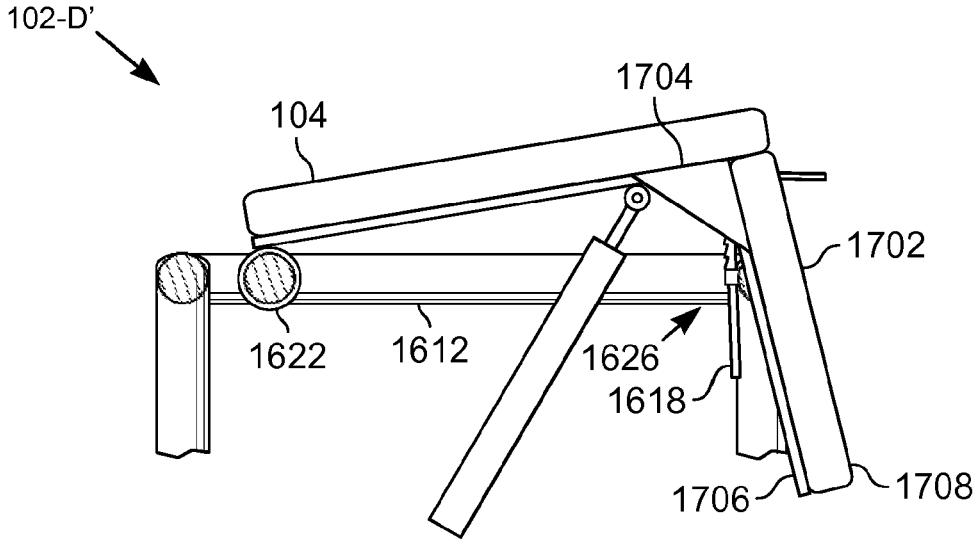
FIG. 17 is a partial side view of another embodiment of an assisted lift chair.

FIG. 17 illustrates a partial side view of another embodiment of an assisted lift chair 102-D' with the seat 104 in a tilted position. Extending downward from the forward end of each seat pad 104 is a leg rest 1702. The leg rest 1702 provides support for the legs of the occupant when the seat 104 is tilted back. In various embodiments, the leg rest 1702 forms a right angle or an obtuse angle with the seat 104 such that the lower legs of the occupant are supported comfortably when the seat pads 104 are raised in the front. The length of the leg rests 1702 is sufficient to support the calves of the occupant with the seat pad 104 lifted. In another embodiment, the length is sufficient to support the feet of the occupant.

In the illustrated embodiment, the latching assembly 1626 has a longer ratchet member 1618 that allows the front of the seat 104 to lift higher to aid in cleaning the genital and perineal areas of the seat occupant.

In a manner similar to the seat 104, the leg rest 1702 includes a support member 1706 and a pad 1708. The support member 1706 is a rigid planar member that is a foundation to the pad 1708, which is a resilient cushion. In the illustrated embodiment, the gusset 1704 is attached to support member 1706 for the seat 104 and the leg rest 1702. The gusset 1704 adds rigidity to the leg rest 1702.

Figure 18:
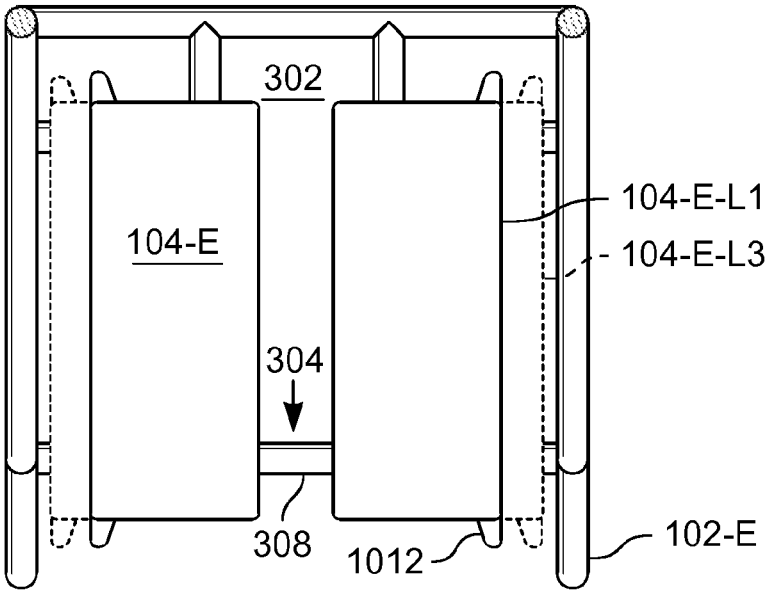
FIG. 18 is a top plan view of another embodiment of a shower chair with a movable seat.
Figure 19:
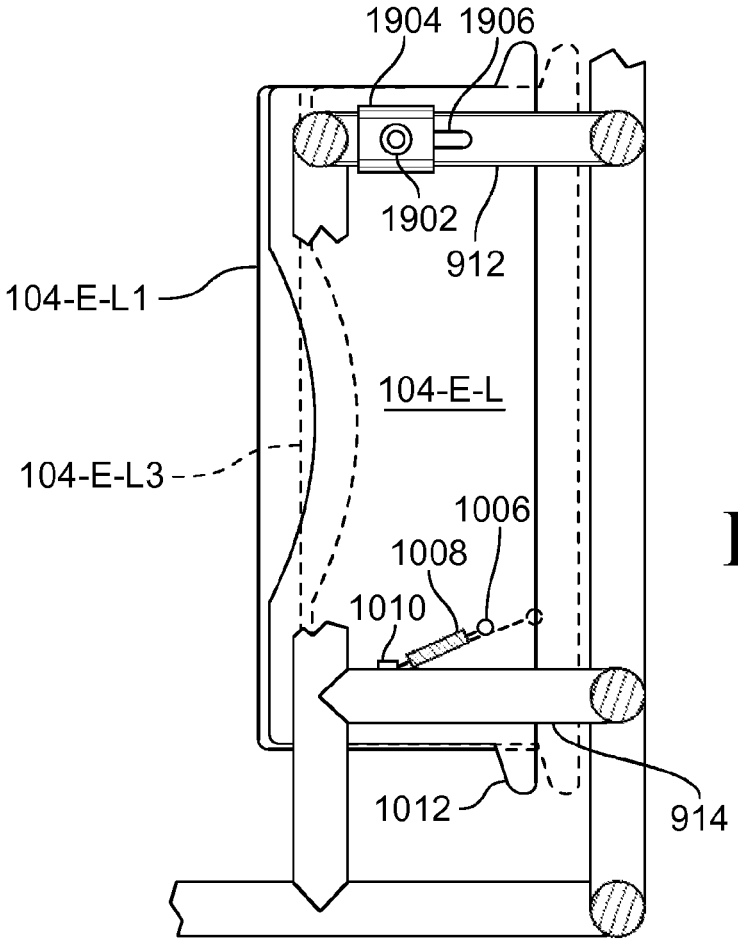
FIG. 19 is a partial bottom view showing another embodiment of a seat pad that moves side-to-side.

FIG. 18 illustrates a top plan view of another embodiment of a shower chair 102-E with a movable seat 104-E. FIG. 19 illus a partial bottom view showing another embodiment of a seat pad 104-E that moves side-to-side. In the illustrated embodiment, each seat pad 104-E is movable sideways from a normal, or closed, position 104-E-L1 to the separated, or open, position 104-E-L3. In another embodiment, only one of the seat pads 104-E is movable sideways.

The illustrated seat pad 104-E is similar to that illustrated in FIG. 10 where the cushion 1004-L and the base 1002-L are configured such that when an occupant sits in the seat, the seat pads 104-E are forced apart by the buttocks engaging the cushion 1004-L and the base 1004-L. If the weight of the occupant is not sufficient to move the seat pad 104-E-L into the separated position 104-E-L3, protrusions, such as handles or knobs, 1012 are positioned at the front and rear ends of the base 1004-L. The handles 1012 are positioned such that an operator can manipulate the handles 1012, such as by pushing with a thumb. A lateral force toward the outer side portion of the frame 118 translates the seat pad 104-E-L to the separated position 104-E-L3. After the occupant is settled in the seat 104-E, the weight of the occupant is sufficient to maintain the seat pad 104-E-L in the separated position 104-E-L3.

The illustrated embodiment of the seat pads 104-E are rectangular with a pair of handles 1012, one at the front and another at the rear. The pair of handles allow the whole seat pad 104-E-L to move towards the side of the chair 102-E. As seen in FIG. 19, the front part of the seat pad 104-R-L is attached to the front seat pad support 912 with a sliding sleeve 1904. The sliding sleeve 1904 is secured to the seat pad 104-R-L by a through bolt 1902 that passes through a slot 1906 in the front seat pad support 912. The slot 1906 allows the bolt 1902 to move side to side along the front seat pad support 902 and, consequently, allow the sliding sleeve 1904 and the front of the seat 104-E-L to move side to side. The rear of the seat pad 104-E-L includes a handle 1012 that allows the bias of the spring 1008 to be overcome to slide the seat 104-E-L toward the side of the chair 100-E. In another embodiment, a second sliding sleeve working in conjunction with a slot in the rear support 914 is used to ensure that the seat 104-E-L moves side to side.

In another embodiment, the bolt 1902 is a pivot that allows the forward portion of the seat pad 104-E-L to both translate sideways and pivot such that the front portion of the seat pad 104-E-L can be positioned at a different distance from the side of the chair 102-E than the rear portion of the seat pad 104-E-L.

Figure 20:
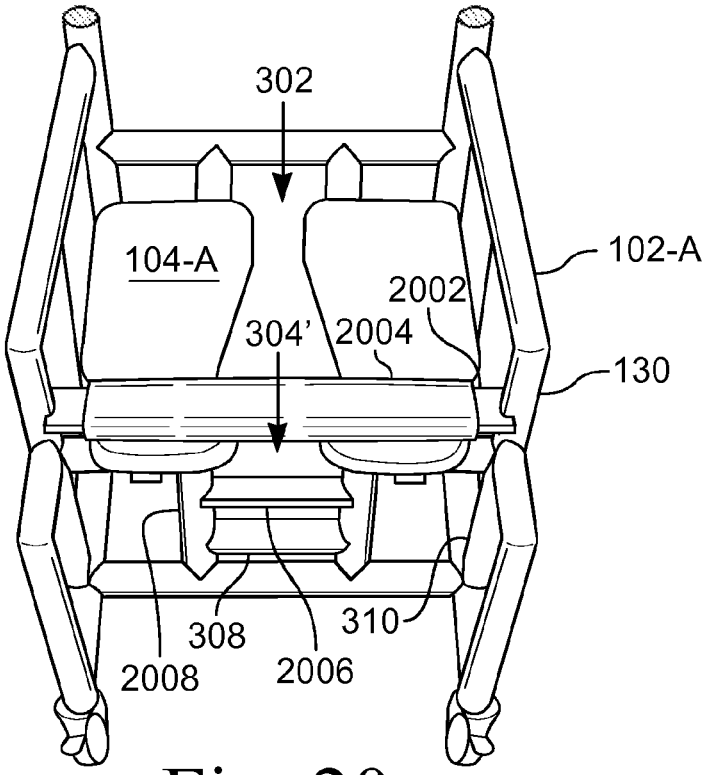
FIG. 20 is a perspective partial front top view of a shower chair showing a towel bar.
Figure 21:
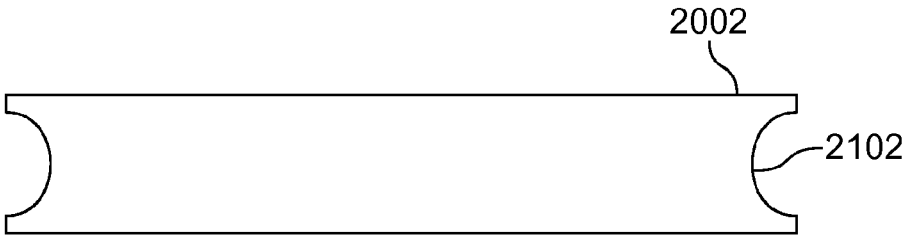
FIG. 21 is a top plan view of an embodiment of a towel bar.

FIG. 20 illustrates a perspective partial front top view of a shower chair 102-A showing a towel bar 2002 with a towel 2004. FIG. 21 illustrates a top plan view of an embodiment of a towel bar 2002. The towel bar 2002 provides support for the legs of the occupant of the chair 102-A to ensure that one or both of the legs of the occupant do not fall with the gap 304 between the front of the seat pads 104-A.

The towel bar 2002 is an elongated member with the ends 2102 configured to mate with the forward vertical supports 130 for the arms of the chair 102-A. In the illustrated embodiment, the ends 2102 are curved to match the cylindrical shape of the supports 130. The length of the towel bar 2002 is such that the two ends 2102 engage the supports 130 for each of the arm rests of the chair 102-A.

To deploy the towel bar 2002, a towel 2004 is wrapped around the bar 2002. The towel bar 2002 is then positioned on the forward end of the seat pads 104-A by engaging one support 130 with one end 2102 and then moving the other end 2102 downward to engage the opposite support 130. The towel bar 2002 is then pushed down so that it rests on the top of the seat pads 104-A. After the towel bar 2002 is in position, the occupant is seated in the chair 102-A.

The position of the towel bar 2002 above the seat pads 104-A does not restrict access through the front access area 304 between the pair of pads 104-A and between the pair of pads 104-A and the cross-member 308. Accordingly, the occupant can still be cleaned from the anterior position.

Figure 22:
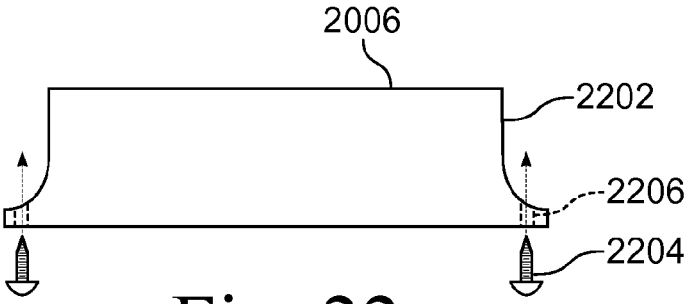
FIG. 22 is a top plan view of another embodiment of a bar.

FIG. 22 illustrates a top plan view of an embodiment of a bar 2006. As illustrated in FIG. 20, the bar 2006 fits between the two upright supports 2008 between the seat pads 104-A and the front support 124. The bar 2006 is sufficiently below the bottom of the seat pads 104-A such that the front access area 304' is sufficiently large for a caregiver to reach into the front access area 304' and clean the genital and perineal area of the seat occupant. Also, the bar 2006 is sufficiently high such that a leg of a slender seat occupant cannot fall between the seat pads 104-A and become uncomfortably lodged between the pads 104-A. That is, the bar 2006, or in another embodiment the crossbar 308, is sufficiently high that a slender seat occupant is readily and easily restored to a proper seated position with the upper legs, or thighs, on the seat pads 104-A if a leg of the occupant were to fall between the seat pads 104-A.

The bar 2006 has arcuate ends 2202 configured such that the bar 2006 fits between the two upright supports 2008 when inserted from the front. Each end of the bar 2006 has a through-hole 2206 into which a fastener 2204 fits. The fastener 2204 extends through the through-hole 2206 to engage the corresponding upright support 2008 secure the bar 2006 to the upright support 2008.

The bar 2006 in one embodiment is used with a towel wrapped around it. In another embodiment, the bar 2006 is used without a towel. In such an embodiment, the edges of the bar 2006 are rounded or smoothed to avoid discomfort from bodily contact. In another embodiment, the cross-bar 308 is positioned at a height equal to that illustrated for the bar 2006. In this way the cross-bar 308 provides both structural strength to the chair 102-A and assists in preventing the occupant's leg from falling into an awkward position.

The full perineal wash system 100 includes various functions. The function of providing access to the perineum of a person who is sitting is implemented, in one embodiment, by the seat 104 with a pair of pads 104-L, 104-R that are separated from each other and from adjacent support members with a gap sized to allow a caregiver to reach the genital area and the ventral perineal area from the front of the seat 104 and the anal area and the dorsal perineal area from the rear of the seat 104.

The function of minimizing contamination with waste and fecal matter is implemented, in one embodiment, by a shower chair 102 that has a frame 118 configured to allow a waste receptacle 202 to fit under the seat 104. The frame 118 is open in the rear, allowing the chair 102 to be backed up to position the chair 102 over the waste receptacle 202.

The function of moving a seat assembly 700 between an upright position and a lowered position is implemented, in one embodiment, by a seat 104 attached to a hinge 704 on a surface 702 with the rear of the seat 104 supported a selected distance 402 from the hinge 704.

The function of separating the seat pads 104-R, 104-L is implemented, in one embodiment, by the pad pivot mechanism 900, which allows the rear portion of at least one seat pad 104-L to move laterally away from the other seat pad 104-R. In another embodiment, each seat pad 104'-L has a pivot on one end and a biasing spring on the opposite end.

From the foregoing description, it will be recognized by those skilled in the art that a full perineal wash system 100 has been provided. The system 100 allows the perineum of a seated person to be washed by a caregiver without the seated person having to get up from the seated position or being otherwise manipulated to remove a body portion from the seat 104. The system 100 provides a washer 106 that sprays a liquid on the perineum of a seated person while minimizing the contamination of the caregiver by allowing the caregiver to direct the spray of liquid from a distance. The system 100 accommodates a portable chair 102, such as a shower chair 102-A, and a fixed chair, such as a fold-up seat assembly 700 or a fixed chair.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus providing access to a perineum of a seated person, said apparatus comprising:

a first pad;

a second pad spaced apart from said first pad with a gap therebetween, said first and second pads defining a seat dimensioned and configured to receive the buttocks of the seated person;

a frame attached to said first pad and said second pad wherein said seat is supportable at a height suitable for the seated person to sit upon said seat, said first pad, said second pad, and said frame defining a first access area and a second access area, said first access area dimensioned and configured to allow access by another person to a ventral perineal area of the seated person, said second access area dimensioned and configured to allow access by said other person to a dorsal perineal area of the seated person;

a first movable connection between said first pad and said frame wherein said first pad is movable between a first position and a second position when said first and second pads are supporting the buttocks of the seated person, said first pad biased toward said second pad, said second position defined by a rear gap between said first and second pads that is wider than when said first pad is in said first position; and a plurality of wheels attached to said frame whereby said apparatus is a chair configured to transport the seated person.

2. The apparatus of claim 1 wherein said first pad includes a pivoting connection to said frame, said pivoting connection proximate a front of said first pad whereby said pivoting connection has an axis of rotation perpendicular to a plane defined by said first pad and said second pad.

3. The apparatus of claim 1 further including a second movable connection between said second pad and said frame wherein said second pad is movable between a first position and a second position, said second position defined by a rear gap between said first and second pads that is wider then when said second pad is in said first position.

4. The apparatus of claim 3 further including a pair of pivoting connections to said frame, each one of said pivoting connections proximate a front of a corresponding one of said first pad and said second pad whereby each one of said pivoting connections has an axis of rotation perpendicular to a plane defined by a corresponding one of said first pad and said second pad.

5. The apparatus of claim 4 wherein proximate a rear of each one of said first pad and said second pad is a protrusion whereby a corresponding one of said first and second pads is movable laterally when a force is applied to one of said protrusions.

6. The apparatus of claim 4 wherein a rear portion of said first pad is biased toward said second pad and a rear portion of said second pad is biased toward said first pad when said first and second pads are in said first position and when said first and second pads are in said second position.

7. The apparatus of claim 4 wherein each of said first and second pads includes a base and a cushion, each said base having a concave edge between a front and a rear of said base, each said concave edge being said edge proximate said gap between said first and second pads, and each said cushion extending over a corresponding one of said concave edge, each said concave edge dimensioned whereby when the buttocks engage each said cushion, said first and second pads each move to a corresponding one of said second position.

8. The apparatus of claim 1 wherein said first access area is defined by said gap between said first and second pads, said first access area further defined by a clear zone proximate said gap and extending below said gap a distance sufficient to accommodate a person's hand when the seated person is occupying said seat.

9. The apparatus of claim 1 wherein said second access area is defined by said gap between said first and second pads, said second access area further defined by a clear zone proximate said gap and extending below said gap and behind said first and second pads a distance sufficient to accommodate a person's hand when the seated person is occupying said seat.

10. The apparatus of claim 1 wherein said seat and said frame are configured as a free-standing chair.

11. The apparatus of claim 1 further including a first gas spring having a first end connected to said first pad, said first gas spring having a second end connected to said frame, said first pad connected to said frame with a hinge whereby said first gas spring forces said first pad between a first position and a second position wherein said seat is substantially horizontal when said first pad is in said first position and said seat is tilted from horizontal when said first pad is in said second position.

12. The apparatus of claim 11 further including a first leg support and a second leg support, said first leg support having an end proximate a forward end of said first pad, said second leg support having an end proximate a forward end of said second pad, and said first and second leg supports moving in tandem with said first and second pads.

13. The apparatus of claim 1 further including a first gas spring having a first end connected to said first pad, said first gas spring having a second end connected to said frame, said first pad connected to said frame with a hinge whereby said first gas spring forces said first pad between a first position and a second position, and further including a second gas spring having a first end connected to said second pad, said second gas spring having a second end connected to said frame, said second pad connected to said frame with a hinge whereby said second gas spring forces said second pad between a first position and a second position.

14. The apparatus of claim 1 further including a bridge member configured to fit between a pair of vertical members proximate said first access area whereby said bridge member is configured and positioned to block a leg of the seated person from becoming lodged between said first and second pads.

15. The apparatus of claim 14 wherein said bridge member is configured to fit between a pair of vertical members extending above said first and second pads, said bridge member bridging a gap between said first and second pads above first access area.

16. An apparatus providing support for a seated person, said apparatus comprising:

a first pad;

a second pad spaced apart from said first pad with a gap therebetween, said first and second pads defining a seat dimensioned and configured to receive the buttocks of the seated person, said first pad movable between a first position and a second position when said first and second pads are supporting the buttocks of the seated person, said first pad biased toward said second pad, a rear portion of said gap being wider with said first pad in said second position than when said first pad is in said first position and wherein said rear portion of said gap in said second position is sufficiently wide to spread the buttocks of the seated person to allow access to an anal area of the seated person; and a frame connected to said first pad and said second pad wherein said seat is supportable at a height suitable for the seated person.

17. The apparatus of claim 16 further including a handle connected to said first pad, said handle operatively moving said first pad between said first position and said second position.

18. The apparatus of claim 16 wherein said first pad includes a pivoting connection to said frame, said pivoting connection proximate a front of said first pad whereby said pivoting connection has an axis of rotation perpendicular to a plane defined by said first pad and said second pad.

19. The apparatus of claim 16 wherein said first pad is connected to a spring that biases said first pad toward said first position when said first pad is in said second position.

* * * * *